US005240020A

United States Patent [19]

Byers

[11] Patent Number: 5,240,020

[45] Date of Patent: Aug. 31, 1993

[54] RETRACTABLE FISHERMAN'S SHADE AND METHOD FOR OPERATING

[76] Inventor: Wayne L. Byers, 12209 Medan St., Orlando, Fla. 32821

[21] Appl. No.: 706,331

[22] Filed: May 28, 1991

[51] Int. Cl.[5] ..... E04H 15/02

[52] U.S. Cl. ..... 135/96; 135/105; 135/106; 135/112; 297/184.15

[58] Field of Search ..... 135/90, 96, 105, 106, 135/107, 108, 112, 109; 297/184, 400

[56] References Cited

U.S. PATENT DOCUMENTS

| | | | |
|---|---|---|---|
| 2,618,285 | 11/1952 | Heisig | 135/90 |
| 2,984,249 | 5/1961 | Sears, Jr. et al. | 135/90 X |
| 3,856,030 | 12/1974 | Sato | 135/22 |
| 4,201,416 | 5/1980 | Vanderminden | 297/184 |
| 4,635,667 | 1/1987 | Harn | 135/90 |
| 4,823,821 | 4/1989 | Day | 135/24 |
| 5,000,210 | 3/1991 | Worthington, Jr. | 135/90 |
| 5,013,085 | 5/1991 | Craig | 135/90 X |
| 5,058,613 | 10/1991 | Su et al. | 135/24 X |
| 5,060,684 | 10/1991 | Wu | 135/24 X |

FOREIGN PATENT DOCUMENTS

| | | | |
|---|---|---|---|
| 2322565 | 4/1977 | France | 297/184 |

*Primary Examiner*—Carl D. Friedman
*Assistant Examiner*—Lan M. Mai
*Attorney, Agent, or Firm*—James H. Beusse

[57] ABSTRACT

A retractable and collapsible shading device for attachment to a chair having a tubular frame for accommodating a canvas screen or the like. The tubular frame can be adjusted as to length and width. A tubular mid-frame section attached to the tubular frame widthwise allows the frame to pivot. Two vertical supports are connected to the tubular mid-frame section and are snap fitted to the chair. A horizontal support arm is connected to the two vertical supports. A spring-loaded support arm is connectable to the tubular frame and is pivotally connected to the horizontal support arm.

15 Claims, 3 Drawing Sheets

RETRACTABLE FISHERMAN'S SHADE AND METHOD FOR OPERATING

BACKGROUND OF THE INVENTION

Field of the Invention

The present invention relates to outdoor sporting equipment, e.g., to fishing equipment and accessories. More particularly, the present invention relates to a shade made of canvas, cloth or vinyl or similar material which is supported by a frame structure which is attached to a spring-loaded support arm. The shade, of course, allows a fisherman to be protected from the rays of the sun while fishing. A line connected to the person of the fisherman is attached to a pin in the support arm so that when the fisherman arises from a seated position, the support arm retracts causing the shade to assume a more vertical position which allows the fisherman to assume an unrestrained standing position.

Discussion of the Background

Participants in outdoor-oriented activities such as fishing are often exposed to intense sun rays. These sun rays often result in sunburn and overheating of the outdoor enthusiast and diminish enjoyment and the amount of time which can be safely allotted to an outdoor activity. In addition, exposure to intense sunlight has prolonged and long term effects. Many an outdoor enthusiast has ended up in the hospital with acute sunburn after a weekend frolic. The energy draining effects of sunlight result in short-term lower productivity in the work place and the long-term possibility of skin cancer.

Umbrellas have often been used to ward off the rays of the sun. However, light weight umbrellas typically require that a person hold the umbrella which precludes the use of both hands for other activity. If large umbrellas are used in a small boat, they often preclude and disrupt the maneuverability of fishing enthusiasts. The pleasant scene in which a person is peacefully fishing under the shade of an umbrella has often turned chaotic when a fish grabs the line, and the person stands to reel in the fish thereby hitting his or her head on the umbrella and knocking the umbrella over. Thus, large umbrellas are usually cumbersome and unsuitable for sporting use.

Therefore, a need exists for a shade device which can be used by sports fisherman and other outdoor enthusiasts which is lightweight and allows a person to stand and move freely. Ideally the device should be collapsible and retractable so as to be stored and carried easily.

SUMMARY OF THE INVENTION

Accordingly, one object of the present invention is to provide a novel shading device which is easily portable, collapsible and retractable.

Another object of the present invention is to provide a novel shading device which is easily assembled.

Yet another object of the present invention is to provide a portable shading device which when installed allows an individual to stand and maneuver freely.

These and other valuable objects and advantages of the present invention are provided by a retractable shade assembly having a frame means which supports a means for blocking sun rays. The means for blocking sun rays is understood to be canvas cloth, tarpaulin, plastic or other suitable material. The frame means is comprised of a first lengthwise insertable tubular section which slidably and insertably fits in a first lengthwise accommodating tubular section. The frame means is further comprised of a second lengthwise insertable tubular section which slidably and insertably fits in a second lengthwise accommodating tubular section.

The frame means is further comprised of a first widthwise accommodating tubular section which connects to the first lengthwise insertable tubular section. A first widthwise insertable tubular section connects to the second lengthwise insertable tubular section. The first widthwise insertable section is slidably and insertably fit in the first widthwise accommodating section. The first widthwise insertable section and the first widthwise accommodating section are located at one end of the frame means.

At an opposite end of the frame means are located a second widthwise insertable tubular section which slidably and insertably fits in a second widthwise accommodating tubular section. The second widthwise accommodating tubular section is connected to the second lengthwise accommodating section and the second widthwise insertable tubular section is connected to the first lengthwise accommodating tubular section.

The retractable shade assembly further comprises an attachment means for connecting the frame means to a chair, the attachment means comprising a mid-frame first insertable tubular section which is connected to the first lengthwise accommodating tubular section. A mid-frame second insertable tubular section is connected to the second lengthwise accommodating tubular section and slidably and insertably fits into the mid-frame first insertable tubular section. A mid-frame accommodating tubular section surrounds the mid-frame first and second insertable tubular sections such that the mid-frame first and second insertable tubular sections are pivotable thereabout.

The attachment means further comprises a first vertical insertable tubular section connected to one end of the mid-frame accommodating tubular section and a second vertical insertable tubular section connected to an opposite end of the mid-frame accommodating tubular section. The first vertical insertable tubular section is slidably and insertably connected to a first vertical accommodating tubular support which is connectable to the chair. A push button spring attached to the first vertical insertable tubular section locks into place in an aperture in the first vertical accommodating tubular support.

The second vertical insertable tubular section is slidably and insertably connected to a second accommodating vertical tubular support which is connectable to the chair. A push button spring attached to the second vertical insertable tubular section locks into place in an aperture in the second vertical accommodating vertical support. A horizontal support arm is connected to the first and second vertical accommodating tubular sections.

A spring-loaded support arm means is connectable to the second widthwise accommodating tubular section, the spring-loaded support arm means being pivotally connected to the horizontal support arm. The spring-loaded support arm means comprises an insertable tubular support arm, one end of the insertable tubular support arm being connectable to the second widthwise tubular section. The insertable support arm insertably and slidably fits in a accommodating tubular support arm which is pivotally connected to the horizontal support arm. The opposite end of the insertable support arm is connected to a spring which is secured to a closed end of the accommodating tubular support arm so that when the opposite end of the insertable support arm is drawn away from the closed end of the accommodating tubular support arm, the spring is placed in tension.

The insertable support arm and the accommodating support arm are both provided with a plurality of apertures which can be aligned for purposes of inserting a pin which results in the spring being placed in tension and the frame means being positioned at a desired angle with a horizontal plane. If the pin is removed the spring will recoil which substantially increases the angle of the frame means with the horizontal plane. The pin can be tied to a person sitting in the chair so that when the person stands up or moves away from the chair, the pin will come out of the insertable and accommodating support arms causing the spring to recoil.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

When referring to the drawings, it is understood that like reference numerals designate identical or corresponding parts throughout the respective figures.

THE DETAILED DESCRIPTION OF THE INVENTION

Figure 1:
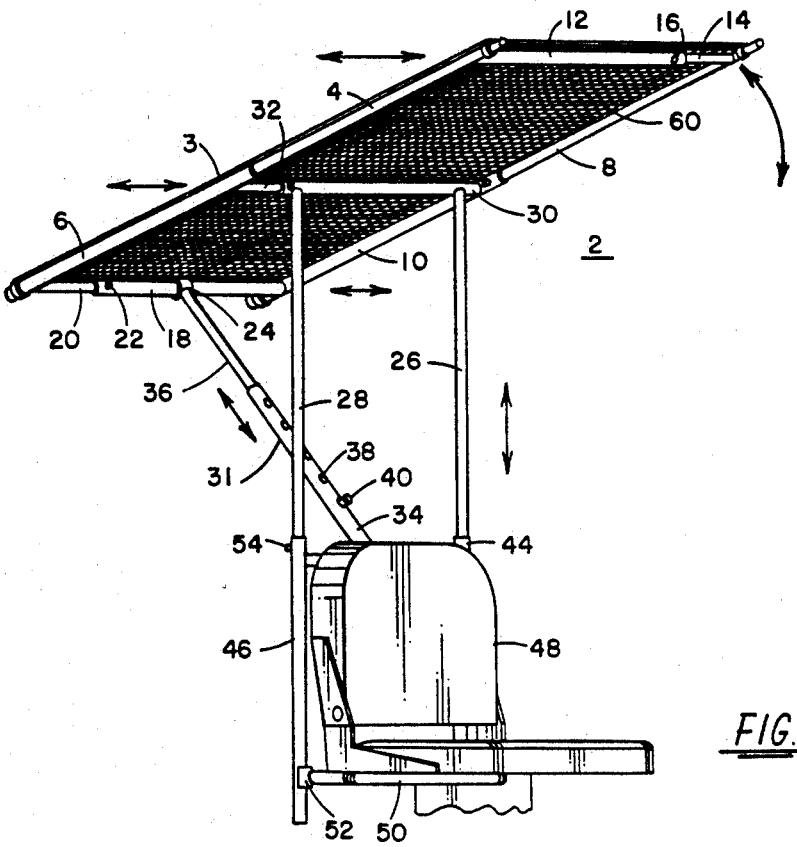
FIG. 1 is a schematic illustration of the retractable fisherman's shade assembly of the present invention.

With reference to FIG. 1, a retractable shade assembly 2 is depicted having a support frame 3. The assembly 2 is comprised of a plurality of tubular sections which are made of aluminum, stainless steel, or other appropriate material (certain plastics will do) which is strong, light in weight and generally resistant to corrosion.

The support frame has a first lengthwise insertable tubular section 4 which slidably and insertably fits in a first lengthwise accommodating tubular section 6. A second lengthwise insertable tubular section 8 slidably and insertably fits in second lengthwise accommodating tubular section 10. The slidable fit of sections 4 and 6 and of sections 8 and 10 allows lengthwise adjustment of the frame support 3.

A first widthwise accommodating tubular section 12 is spot welded to the first lengthwise insertable tubular section 4. (The prototype of the present invention is made of aluminum with spot welding being used to provide secured connections where appropriate; however, if other materials are used for the frame support the tubular sections would be connected by a process appropriate for the given material).

A first widthwise insertable tubular section 14 is welded to the second lengthwise insertable tubular section 8. The first widthwise insertable section 14 is slidably and insertably fit in the first widthwise accommodating tubular section 12. A push button spring mechanism attached to section 14 locks in an aperture in the section 12 indicated at 16 for purposes of locking the sections 12 and 14 together.

A second widthwise accommodating tubular section 18 is spot welded to second lengthwise tubular section 10. Second widthwise insertable tubular section 20 is spot welded to first lengthwise accommodating tubular section 6. Second widthwise insertable tubular section 20 slidably and insertably fits in second widthwise accommodating tubular section 18. A push button spring mechanism attached to section 20 locks in an aperture indicated at 22 for purposes of locking sections 20 and 18. The slidable fit of sections 18 and 20 and of sections 12 and 14 allows the support frame 3 to be adjustable widthwise.

The accommodating sections of the prototype support frame of the present invention are approximately one inch in diameter and the insertable sections are approximately ⅞ of an inch in diameter. Other diameters can, of course, be implemented without deviating from the spirit of the invention.

A mid-frame attachment means comprised of mid-frame first insertable tubular section 32, mid-frame second insertable tubular section 33, and accommodating tubular section 30 connects to sections 6 and 10. Sections 32, 33 and 30 provide an axis on which the frame support 3 can be pivoted. Section 33 is not shown in FIG. 1 but will be discussed subsequently in the commentary concerning FIG. 4.

The attachment means further comprises a first vertical insertable tubular section 26 which is connected to mid-frame accommodating section 30. A second vertical insertable tubular section is likewise connected to section 30. First vertical insertable tubular section 26 slidably and insertably fits in first accommodating vertical tubular support 44. Second vertical insertable tubular section 28 slidably and insertably fits in second accommodating vertical tubular support 46. Push button springs 54 are provided at the ends of insertable sections 26 and 28 for insertion into apertures located in section 44 and 46, respectively. The push button springs 54 provide a means by which sections 26 and 44 and sections 28 and 46 are locked together so sliding of the insertable sections 26 and 28 is prevented. A horizontal support bar 55 (see FIGS. 5 and 6) connects to vertical accommodating support sections 44 and 46.

The retractable shade assembly is further provided with a spring-loaded support arm 31 which is comprised of an insertable support arm 36 which fits in accommodating support arm 34. The accommodating support arm 34 is provided with apertures 38 which can be aligned with apertures 37 in insertable support arm 36 (see FIGS. 2 and 3) to accommodate a pin 40. The insertable support arm 36 is connectable to tubular section 18 by means of snap-fitting connection 24 which is formed to accommodate the circumference of tubular section 18.

Still referring to FIG. 1, a chair 48 is provided with supports 50 on each side of the chair which connect to snaps 52. Snaps 52 are snap-fitted to tubular sections 46 and 48.

Figure 2:
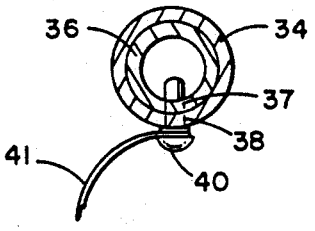
FIG. 2 is a cross sectional illustration of the pin of the present invention positioned in the apertures of the insertable support arm and accommodating support arm of the present invention.

With reference to FIG. 2, a cross sectional illustration shows a pin 40 extending through aperture 38 in accommodating support arm 34 and extending through aperture 37 in insertable support arm 36. A line 41 is connected to pin 40.

Figure 3:
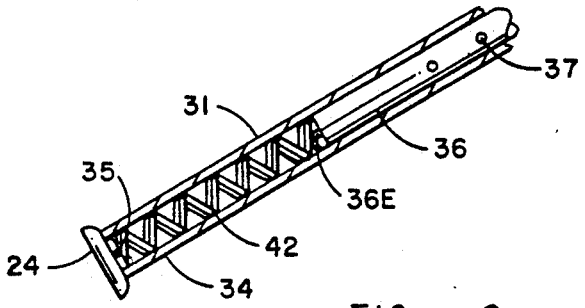
FIG. 3 is a cutaway view giving a schematic illustration of how a spring connects to a closed end of the accommodating support arm and to an end of the insertable support arm according to the present invention.

The following discussion with reference to FIG. 3 provides an understanding of how support arm 31 is spring loaded. The inserted end 36E of insertable support arm 36 is connected to a spring 42 (i.e., a bungy chord) which is secured to the closed end 35 of accommodating support arm 34. The insertable support arm 36 has apertures 37 whose purpose has been discussed.

Figure 4:
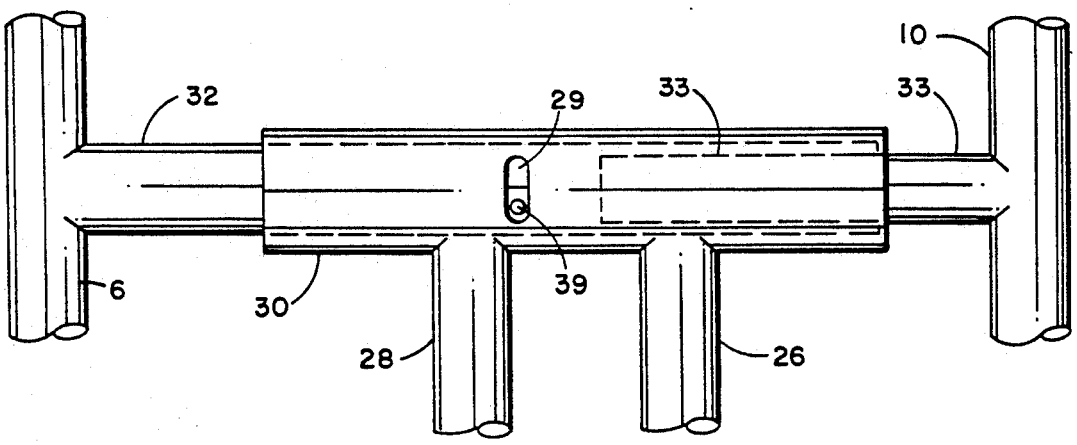
FIG. 4 is a schematic illustration of the pivotable mid-frame attachment means of the present invention.

FIG. 4 is informative in regard to the mid-frame attachment means of the present invention. Connected to first lengthwise accommodating tubular section 6 is mid-frame first insertable tubular section 32. Section 32 is slidably and insertably fit into mid-frame accommodating tubular section 30. Mid-frame second insertable tubular section 33 is connected to second lengthwise accommodating tubular section 10 and is inserted into accommodating tubular section 30 so as to be located radially inward of mid-frame first insertable section 32. Section 32 is provided with a push button spring 39 which locks in an elongated aperture 29 of accommodating tubular section 30. Aperture 29 is approximately 1.25 inches long to allow rotational movement of mid-frame first insertable section 32. Aperture 29 has a width which is designed to prevent widthwise movement of section 32 relative to section 30.

Figure 5:
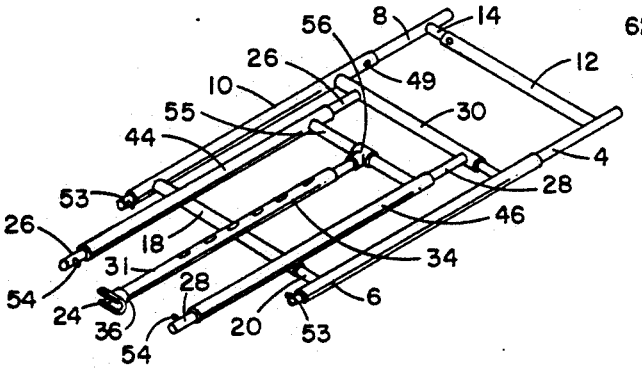
FIG. 5 is a schematic illustration of the fisherman's shade assembly of the present invention in a collapsed and retracted state.

FIG. 5 shows the retractable assembly of the present invention in a collapsed and retracted state as would be the case when storing the assembly or when carrying the assembly to an outdoor location. First widthwise insertable tubular section 14 is fully inserted into first widthwise accommodating section 12. Mid-frame insertable tubular section 32 is fully inserted into mid-frame accommodating section 30, and second widthwise insertable tubular section 20 is fully inserted into second widthwise accommodating tubular section 18. First lengthwise insertable tubular section 4 is fully inserted into first lengthwise accommodating section 6 such that push button spring 53 on the end of section 4 is exposed. Likewise, second lengthwise insertable tubular section 8 is fully inserted into second lengthwise accommodating section 10 such that push button spring 53 at the end of section 8 is exposed. When section 8 is fully extended push button spring 53 is locked in aperture 49 of section 10. A similar aperture (not shown) is present in section 6 for accommodating push button spring 53 of section 4.

Still with reference to FIG. 5, first and second vertical insertable tubular sections 26 and 28 are fully inserted into first and second accommodating vertical supports 44 and 46, respectively, thereby exposing push button springs 54. Insertable support arm 36 is inserted in accommodating support arm 34 in a manner in which the spring 42 (FIG. 3) is fully recoiled and not in tension. Rotatable connector 56 surrounds horizontal support arm 55 to provide a pivotable connection for accommodating support arm 34. Thus when storage of the retractable shade assembly is desired, support arm 31 is easily laid over section 18 in the manner shown.

The present invention has a length of approximately 48 inches when fully assembled and extended and a length of approximately 20 inches when in the collapsed and retracted state, with an extended width of 36 inches and a collapsed width of 22 inches. Obviously the present invention can be designed to accommodate different lengths and widths without departing from the scope of the claimed invention.

Figure 6:
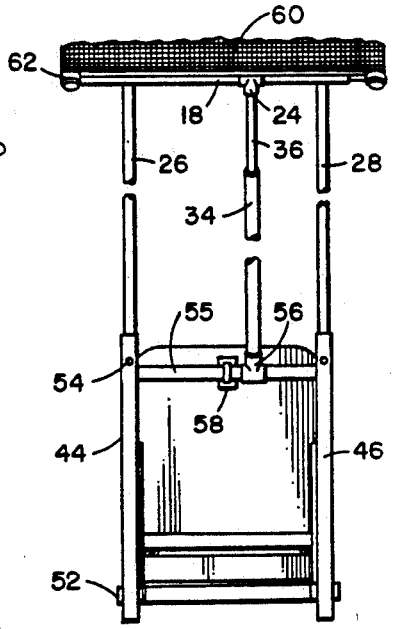
FIG. 6 is a schematic partially exploded illustration which depicts how the spring-load support arm of the present invention is connected to the horizontal arm and support frame according to the present invention.

In FIG. 6, the back 48B of a chair 48 has a hook-shaped snap 58 which is used to further secure the retractable shade assembly of the present invention by fitting over support arm 55. Vertical supports 44 and 46 are snap fitted to snaps 52 which connect to the chair 48.

Figure 7:
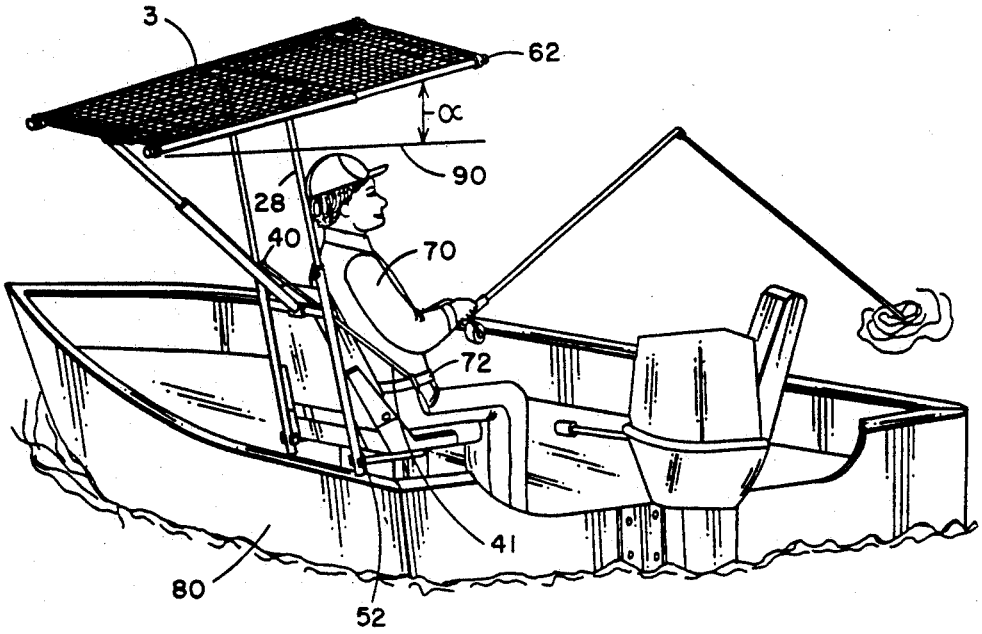
FIG. 7 is a perspective illustration which depicts a situation when the spring of the spring-loaded support arm of the present invention is in tension.

In FIG. 7, a fisherman 70 is seated in chair 48 which is connected to the floor of boat 80. The support frame 3 supports a screen 60 which is made of canvas, tarpaulin, plastic or other suitable material for warding off water and sun rays. The screen 60 is rectangular and provided with loops 62 which fit over the lengthwise extremes of the support frame 3. The support frame is at an angle $\alpha$ with a horizontal plane indicated by line 90. The fisherman 70 is wearing a belt 72 to which is tied a line 41 which is tied to pin 40. The pin 40 is inserted through apertures 38, 37 located in accommodating support arm 34 and insertable support arm 36, respectively.

The angle the support frame has with the horizontal will vary depending on the degree of tension to which spring 42 (FIG. 3) is subjected. Therefore, a plurality of apertures 38 are provided in accommodating support arm 34 so that pin 40 may be inserted through insertable support arm 36 when the end 36E of support arm 36 is at various distances from end 35 of accommodating support arm 34 (see FIG. 3), thereby causing varying degrees of tension in spring 42.

Figure 8:
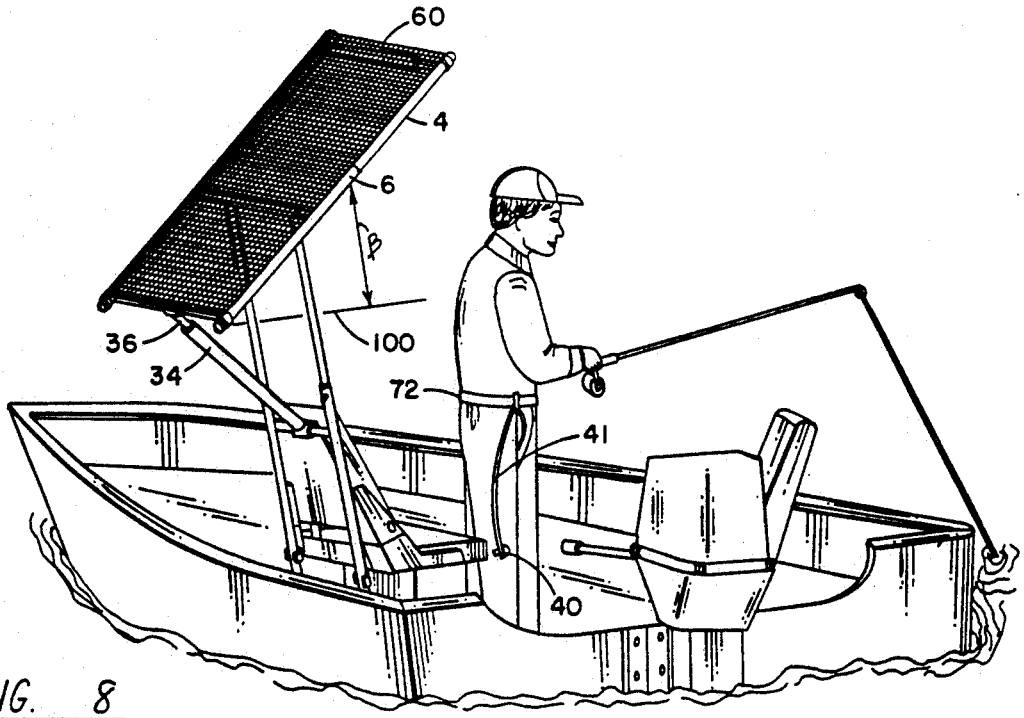
FIG. 8 is a perspective illustration which depicts a situation when the spring of the spring-loaded support arm of the present invention has recoiled.

In FIG. 8, the fisherman 70 has stood up causing the line 41 to pull the pin 40 out of the accommodating support arm 34 and the insertable support arm 36 so that spring 42 has recoiled causing support arm 36 to pull down on section 18 of frame support 3 causing frame support 3 to pivot so that it is at an angle $\beta$ with a horizontal plane indicated by line 100. Since the support frame is now in a high angle position, which it assumes virtually instantaneously upon the pin 40 being removed from the support arms 34, 36, the fisherman is free to maneuver and is unimpeded by the pleasure enhancing, sun protecting, retractable shade assembly of the present invention.

The foregoing detailed description is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. A retractable shade assembly attachable to a chair for protecting a person seated in the chair from the sun, said assembly comprising:

means for shading the person from the sun;

means for pivoting the means for shading, said means for pivoting being connected to the means for shading; and spring-loaded means attached to the means for shading for causing the means for shading to assume a substantially vertical position when the person stands up from the chain, the spring-loaded means being actuated by release of a holding means releasably coupled thereto, said holding means being attached to the person whereby the act of standing releases the holding means.

2. An assembly according to claim 1 wherein the means for shading comprises:

a frame support; and a screen attached to the frame support.

3. An assembly according to claim 2 wherein the means for pivoting comprises:

a mid-frame support means.

4. An assembly according to claim 3 wherein said mid-frame support means comprises:

a first insertable mid-frame tubular section connected to the frame support at one side;

a second insertable mid-frame tubular section located radially inward of said first insertable mid-frame tubular section and connected to an opposite side of said frame support; and an accommodating mid-frame tubular section surrounding said first and second insertable mid-frame sections.

5. An assembly according to claim 4 further comprising:

vertical support means connected to said accommodating mid-frame section and connectable to the chair.

6. An assembly according to claim 5 wherein said spring loaded means comprises:

an insertable support arm connectable to the support frame;

an accommodating support arm into which said insertable support arm is slidably fit; and a spring connected to a closed end of said accommodating support arm, said spring being connected to the inserted end of said insertable support arm.

7. An assembly according to claim 6 wherein said spring-loaded means further comprises:

a pin for inserting in said insertable support arm and said accommodating support causing said spring to be placed in tension.

8. An assembly according to clam 7 further comprising:

a line for attaching to the person so that when the person moves from the chair, the pin is removed causing the insertable support arm to retract.

9. A retractable shade assembly for attachment to a chair, for reducing solar radiation reaching the chair, said assembly comprising:

frame means for supporting a solar radiation reducing material over the chair;

means for attaching said frame means to the chair;

spring-loaded support arm means connected to said frame means for releasably supporting said frame means at a desired angle to a horizontal plane;

mid-frame attachment means connected to said frame means, said mid-frame attachment means comprising a mid-frame accommodating tubular section and a first mid-frame insertable tubular section inserted into said mid-frame accommodating tubular section and a second mid-frame insertable tubular section inserted in said first mid-frame insertable tubular section, such that said mid-frame accommodating tubular section is rotatable about said first and second mid-frame insertable tubular sections; and wherein said means for attaching said frame means to the chair comprises a vertical attachment means connected to said mid-frame accommodating tubular section.

10. An assembly according to clam 9 wherein said frame means further comprises:

means for adjusting a width of said frame means.

11. An assembly according to clam 10 wherein said frame means further comprises:

means for adjusting a length of said frame means.

12. An assembly according to claim 11, wherein said spring-loaded support arm means comprises:

a telescoping support arm having an outer member and an inner member.

13. An assembly according to claim 12, wherein said spring loaded support arm means further comprises:

a spring connected to an end portion of said outer member and connected to an interior end region of said outer member such that when said inner member arm is pulled further away from the interior end region of said outer member, said spring is placed in tension.

14. An assembly according to claim 9, wherein said spring-loaded support arm means comprises:

an insertable support arm connectable to said frame means;

an accommodating support arm; and a spring connected to an end portion of said insertable support arm and connected to an interior end region of said accommodating support such that when said insertable support arm is pulled further away from the interior end region of said accommodating support arm, said spring is placed in tension.

15. An assembly according to claim 14 further comprising:

means for maintaining said spring at a fixed level of tension, said means for maintaining being releasably connected to said insertable support arm and said accommodating support arm, and wherein when said means for maintaining is disconnected from said insertable support arm and said accommodating support arm, said spring recoils.

* * * * *